US010788230B2

(12) United States Patent
Williams et al.

(10) Patent No.: US 10,788,230 B2
(45) Date of Patent: Sep. 29, 2020

(54) PORTABLE DEHUMIDIFIER CONTROL SYSTEM

(71) Applicant: Therma-Stor LLC, Madison, WI (US)

(72) Inventors: Kyle R. Williams, Madison, WI (US); Steven S. Dingle, McFarland, WI (US); Dominic M. Moore, Brooklyn, WI (US); James A. Scharping, Madison, WI (US); Jerome Verhoeven, Sun Prairie, WI (US); Diane K. Bustamante, Eikhorn, WI (US); Conor DuBois, Madison, WI (US)

(73) Assignee: Therma-Stor, LLC, Madison, WI (US)

( * ) Notice: Subject to any disclaimer, the term of this patent is extended or adjusted under 35 U.S.C. 154(b) by 181 days.

(21) Appl. No.: 16/027,638

(22) Filed: Jul. 5, 2018

(65) Prior Publication Data

US 2020/0011556 A1 Jan. 9, 2020

(51) Int. Cl.

| | |
|---|---|
| ***F24F 11/30*** | (2018.01) |
| ***F24F 11/56*** | (2018.01) |
| *F24F 11/52* | (2018.01) |

(52) U.S. Cl.

CPC ..... *F24F 11/30* (2018.01); *F24F 11/56* (2018.01); *F24F 11/52* (2018.01); *F24F 2221/125* (2013.01)

(58) Field of Classification Search

CPC ..... F24F 11/30; F24F 2221/125; F24F 11/56; F24F 11/53

See application file for complete search history.

(56) References Cited

U.S. PATENT DOCUMENTS

2006/0255164 A1* 11/2006 Oppermann ..... F24F 3/14 236/44 C
2016/0305672 A1* 10/2016 Jeon ..... F24F 3/1405
2018/0077881 A1* 3/2018 Lorentz ..... A01G 25/09

FOREIGN PATENT DOCUMENTS

JP 3146515 B2 * 3/2001 ..... F24F 3/153

OTHER PUBLICATIONS

Hamada, Dehumidifier, 2001, Full Document (Year: 2001).*

* cited by examiner

*Primary Examiner* — Elizabeth J Martin
*Assistant Examiner* — Nael N Babaa
(74) *Attorney, Agent, or Firm* — Baker Botts L.L.P.

(57) ABSTRACT

A dehumidifier includes an evaporator, a condenser, a fan, and a processor. In response to determining that a measured relative humidity is greater than or equal to a relative humidity set point, the processor sets the dehumidifier to a first operating mode, wherein a compressor is enabled and the fan is set to a first fan speed while in the first operating mode. The processor further determines whether the dehumidifier has been operating in the first operating mode for a predetermined amount of time, and in response, sets the dehumidifier to a second operating mode if the measured relative humidity is still greater than the relative humidity set point, wherein the compressor is enabled and the fan is set to a second fan speed while in the second operating mode. The second fan speed is greater than the first fan speed.

14 Claims, 10 Drawing Sheets

PORTABLE DEHUMIDIFIER CONTROL SYSTEM

TECHNICAL FIELD

This disclosure relates generally to dehumidification, and more particularly to a portable dehumidifier control system.

BACKGROUND

In certain situations, it is desirable to reduce the humidity of air within a structure. For example, in fire and flood restoration applications, it may be desirable to quickly remove water from areas of a damaged structure. To accomplish this, one or more portable dehumidifiers may be placed within the structure to dehumidify the air and direct dry air toward water-damaged areas. However, current dehumidification systems have proven inefficient in various respects.

SUMMARY

According to embodiments of the present disclosure, disadvantages and problems associated with previous dehumidification systems may be reduced or eliminated.

In some embodiments, a dehumidification system includes an evaporator, a condenser, an air plenum, a fan, a drain pan, a compressor, and multiple support legs. The condenser is positioned proximate to the evaporator. The air plenum is positioned proximate to the condenser so that the condenser is sandwiched between the evaporator and the air plenum. The fan is positioned proximate to the air plenum. The drain pan is disposed partially below the evaporator, the condenser and the air plenum. The compressor is disposed partially below the drain pan. The support legs are disposed below the drain pan and are configured to support the drain pan. The drain pan includes a top piece and a bottom piece disposed partially below the top piece. The top piece of the drain pan includes one or more bottom panels, one or more raised ribs disposed on the one or more bottom panels, a hook configured to hold a float switch, a drainage opening, and a strainer holder positioned proximate to the drainage opening and configured to hold a mesh strainer. The top piece of the drain pan is configured to collect water condensed from the evaporator and drain the condensed water to the bottom piece via the drainage opening. The bottom piece of the drain pan includes a front ledge configured to support an air filter, a central chamber configured to hold the condensed water, and a back shelf configured to support the condenser and the air plenum. The central chamber of the bottom piece includes a base panel, an enclosed wall disposed on the base panel, and a basin positioned proximate to the base panel. The condensed water drained from the top piece is directed into an area of the base panel that is partially surrounded by the enclosed wall.

In some embodiments, a portable dehumidifier includes a cabinet, an evaporator, a condenser, a drain pan, multiple support legs, a compressor, and a fan. The cabinet includes an airflow inlet located on a front side of the cabinet, an airflow outlet located on a side of the cabinet, and at least two wheels coupled to a bottom side of the cabinet. The evaporator is located adjacent to the airflow inlet. The condenser is located adjacent to the evaporator and on a side of the evaporator opposite the airflow inlet. The drain pan is located at least partially below the evaporator and the condenser and is configured to support weight of the evaporator and the condenser. The support legs extend from a bottom side of the drain pan towards the bottom side of the cabinet. The compressor is located below the drain pan. The fan is located adjacent to the condenser and on a side of the condenser opposite the evaporator. The fan is configured to generate an airflow that flows into the cabinet through the airflow inlet and out of the cabinet through the airflow outlet, the airflow flowing through the evaporator and the condenser in order to provide dehumidification to the airflow.

In some embodiments, a method includes setting, in response to determining that a measured relative humidity (RH) is greater than or equal to a relative humidity set point, a dehumidifier to a first operating mode, wherein a compressor of the dehumidifier is enabled and a fan of the dehumidifier is set to a first fan speed while in the first operating mode. In some embodiments, the first fan speed is a low or minimal fan speed. The method further includes determining whether the dehumidifier has been operating in the first operating mode for a predetermined amount of time, and in response, setting the dehumidifier to a second operating mode if the measured relative humidity is still greater than the relative humidity set point. The compressor is enabled and the fan is set to a second fan speed while in the second operating mode. The second fan speed is greater than the first fan speed. The second fan speed may be a high or maximum fan speed.

Certain embodiments of the present disclosure may provide one or more technical advantages. Some embodiments include a unique arrangement of internal components that result in a more compact and efficient portable dehumidifier. For example, some embodiments include a multi-piece drain pan that supports the weight of an evaporator, a condenser, and a filter. In such embodiments, the drain pan may be supported by one or more support legs that extend from a bottom portion of a cabinet upwards towards the drain pan. This allows for a more compact and upright configuration for the portable dehumidifier. In some embodiments, the multi-piece drain pan includes two main components: a top piece and a bottom piece. In such embodiments, the top piece of the drain pan may include raised ribs that prevent air from passing under the evaporator, thereby preventing condensed water from being entrained in the air. This increases the efficiency of the dehumidification system by more efficiently retaining the condensed water in the drain pan. Furthermore, some embodiments of the multi-piece drain pan include a mesh strainer that may be held in place by a strainer holder in the drain pain. The mesh strainer filters the condensed water to prevent debris from reaching the bottom piece of the drain pan and damaging other components (e.g., a pump) of the dehumidification system. In some embodiments, an enclosed wall in the bottom piece of the drain pan is provided to catch any soft particles or sediment that escape the mesh strainer. The enclosed wall provides a second protection mechanism for catching debris or particles in the condensed water and preventing them from damaging other components of the dehumidification system.

Some embodiments provide additional technical advantages by employing an advanced control scheme in order to reduce the amount of noise generated by the portable dehumidifier and to reduce the amount of energy consumed by the portable dehumidifier. In such embodiments, if the portable dehumidifier has been running for a predetermined amount of time (e.g., thirty minutes) without achieving a particular relative humidity set point, a fan speed of the portable dehumidifier may be set to a higher fan speed setting. However, if the portable dehumidifier has succeeded in reducing the humidity levels below the relative humidity set point after the predetermined amount of time, the fan of the portable dehumidifier may be set to a low fan speed in order to reduce noise and energy consumption.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and for further features and advantages thereof, reference is now made to the following description taken in conjunction with the accompanying drawings, in which.

DETAILED DESCRIPTION

In certain situations, it is desirable to reduce the humidity of air within a structure. For example, in fire and flood restoration applications, it may be desirable to quickly remove water from areas of a damaged structure by placing one or more portable dehumidifiers within the structure. Current dehumidifiers, however, have proven inadequate or inefficient in various respects.

The disclosed embodiments provide a dehumidification system that includes various features to address the inefficiencies and other issues with current dehumidification systems. In some embodiments, the dehumidification system includes a drain pan that is configured to efficiently increase the water removal capacity of the dehumidification system. Specifically, the drain pan in some embodiments includes a top piece and a bottom piece. The top piece of the drain pan includes multiple raised ribs which prevent air from passing under an evaporator, thereby preventing the condensed water from being entrained in the air. This increases the efficiency of the dehumidification system by more efficiently retaining the condensed water in the dehumidification drainage system. Furthermore, the top piece in some embodiments includes a strainer holder that holds a mesh strainer. The mesh strainer filters the condensed water to prevent debris from reaching the bottom piece and damaging other components (e.g., a pump) of the dehumidification system. The bottom piece in some embodiments further includes an enclosed wall to catch any soft particles or sediment that escape the mesh strainer. The enclosed wall provides a second protection mechanism for catching debris or particles in the condensed water and preventing them from damaging other components of the dehumidification system.

Figure 1A:
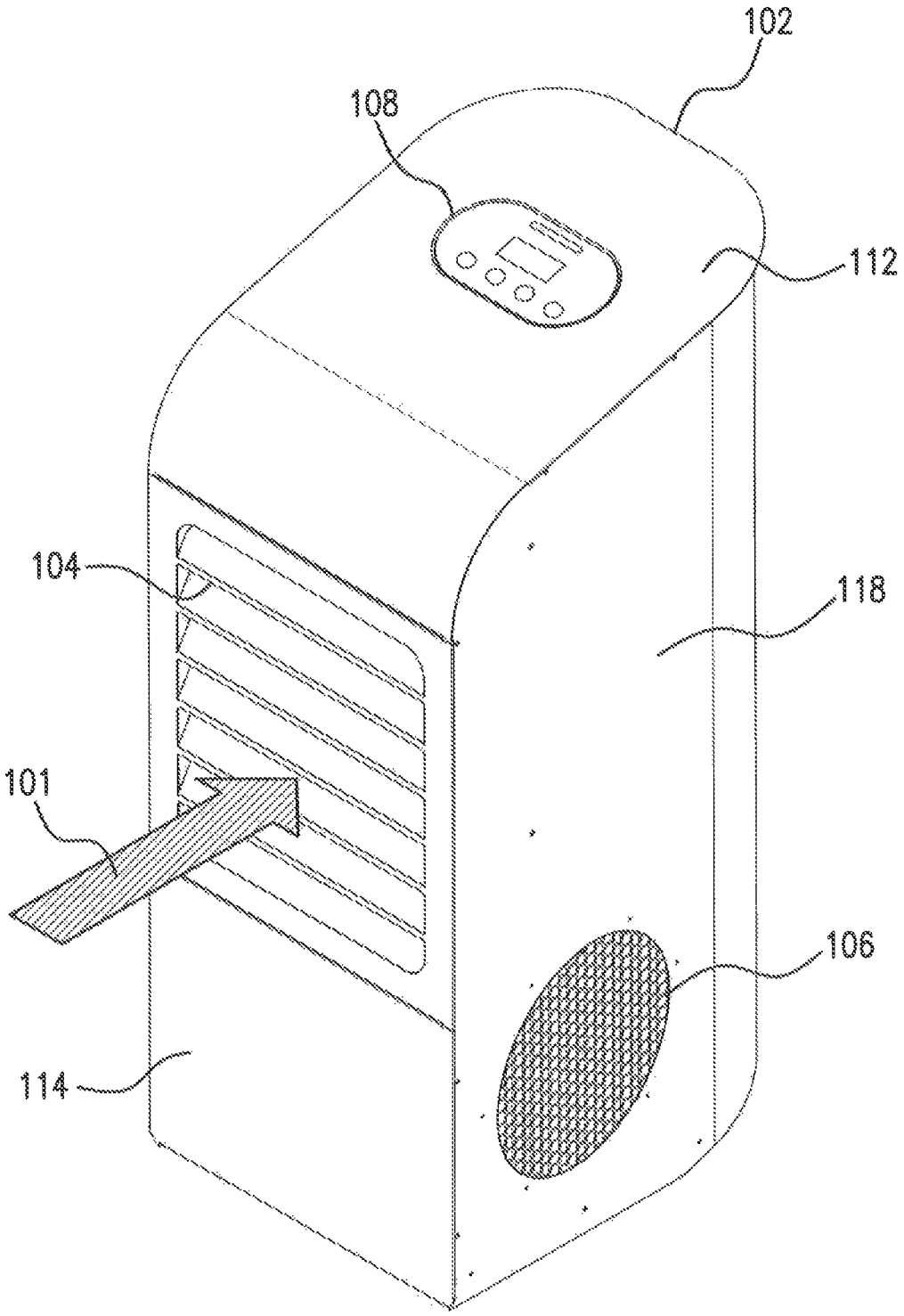
FIGS. 1A and 1B illustrate perspective views of a dehumidification system, according to certain embodiments.
Figure 2:
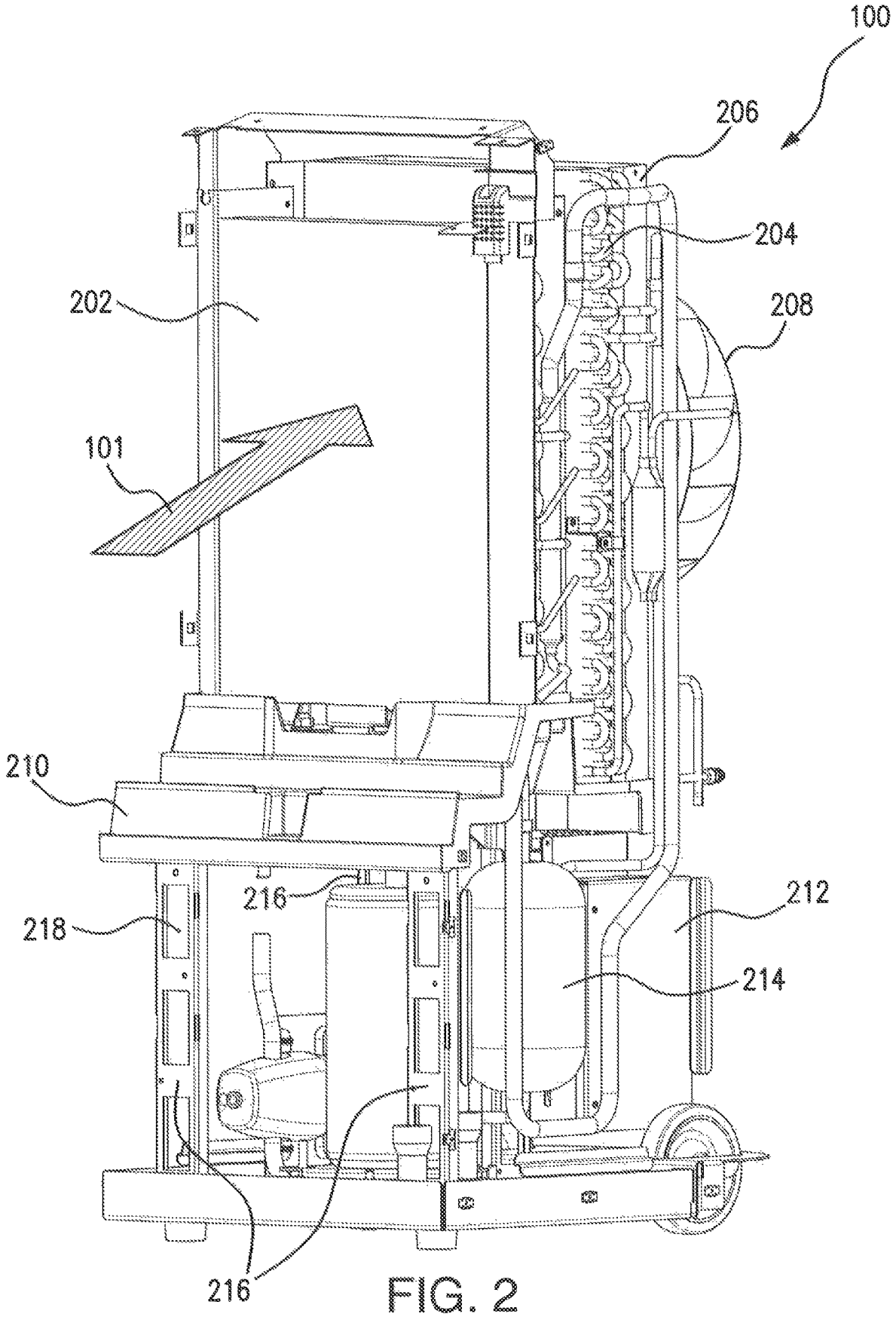
FIG. 2 illustrates internal components of the dehumidification system of FIGS. 1A and 1B, according to certain embodiments.
Figure 3:
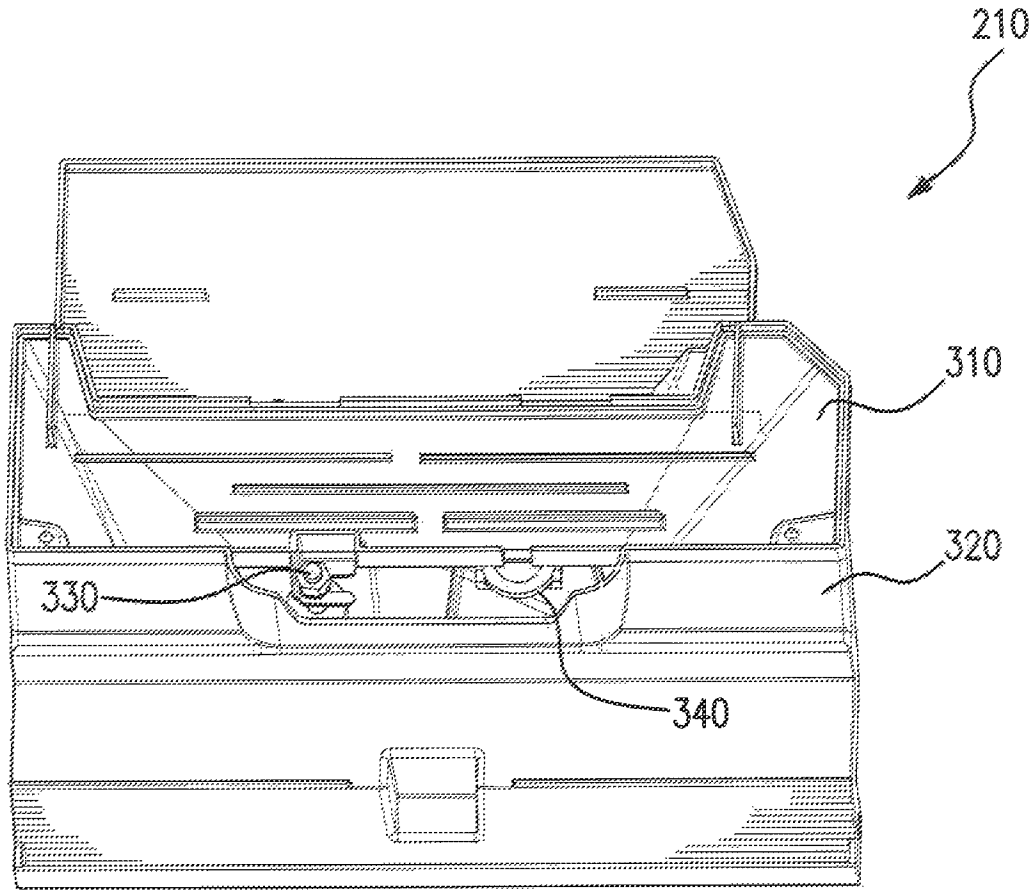
FIG. 3 illustrates a perspective view of a drain pan of the dehumidification system of FIG. 2, according to certain embodiments.
Figure 4A:
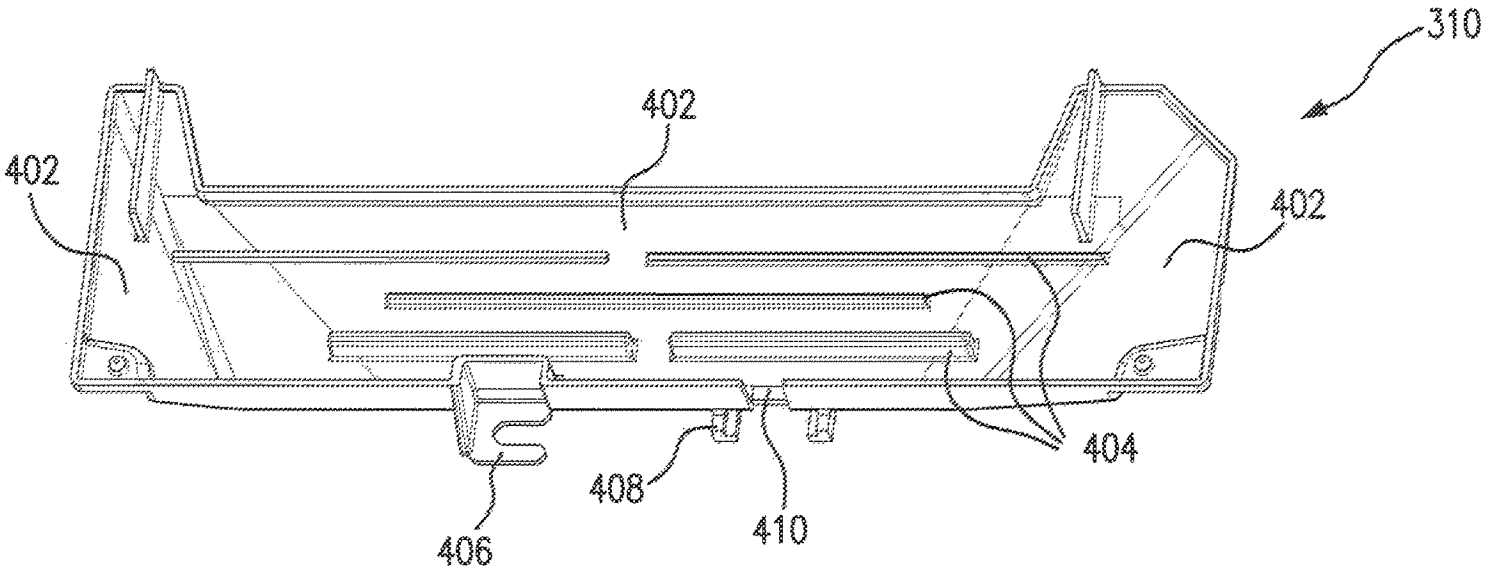
FIGS. 4A and 4B illustrate perspective views of a top piece of the drain pan of FIG. 3, according to certain embodiments.
Figure 4B:
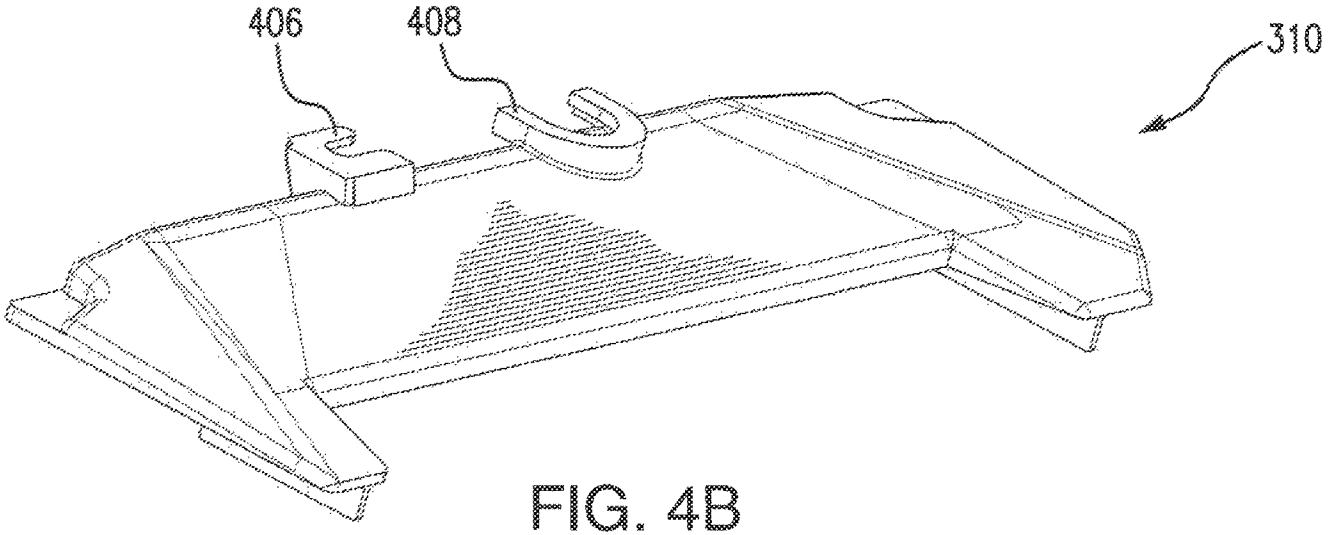
Figure 5B:
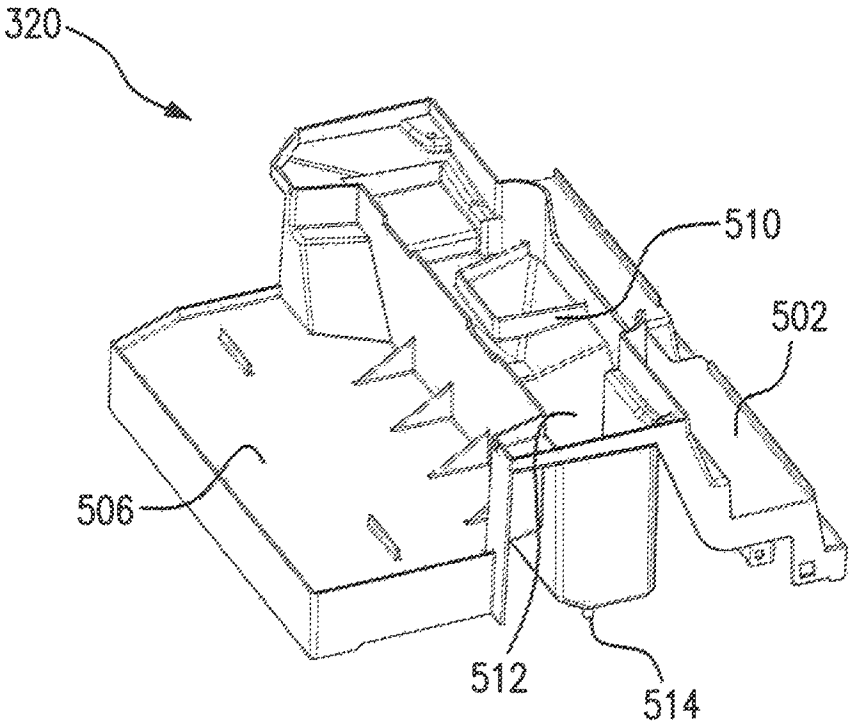
FIGS. 5A and 5B illustrate perspective views of a bottom piece of the drain pan of FIG. 3, according to certain embodiments.
Figure 5A:
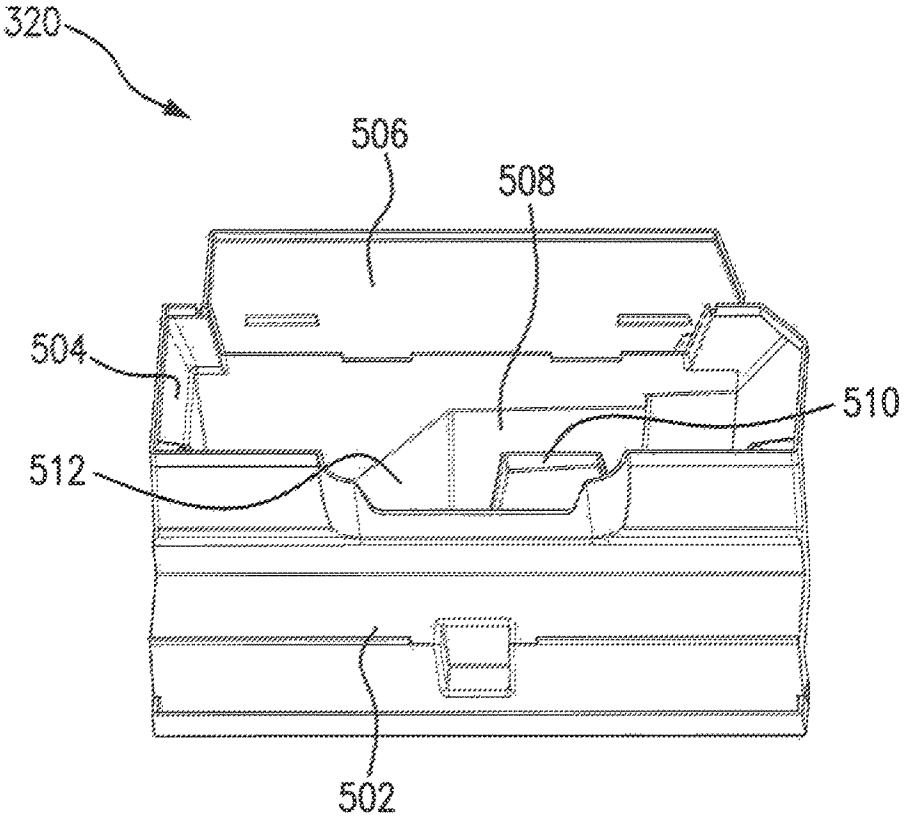
Figure 6:
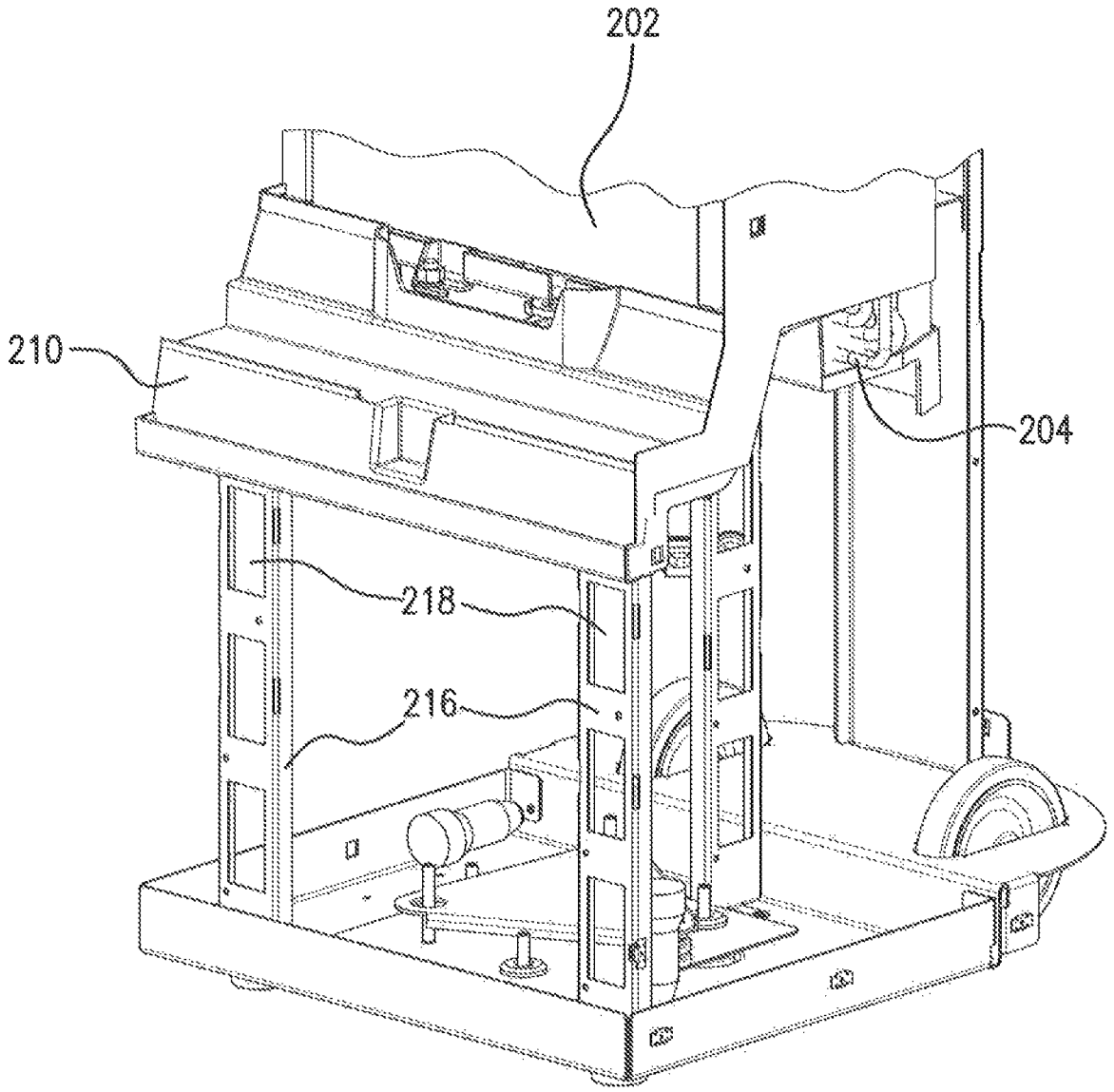
FIG. 6 illustrates support legs that may support the drain pan of FIG. 3, according to certain embodiments.
Figure 7:
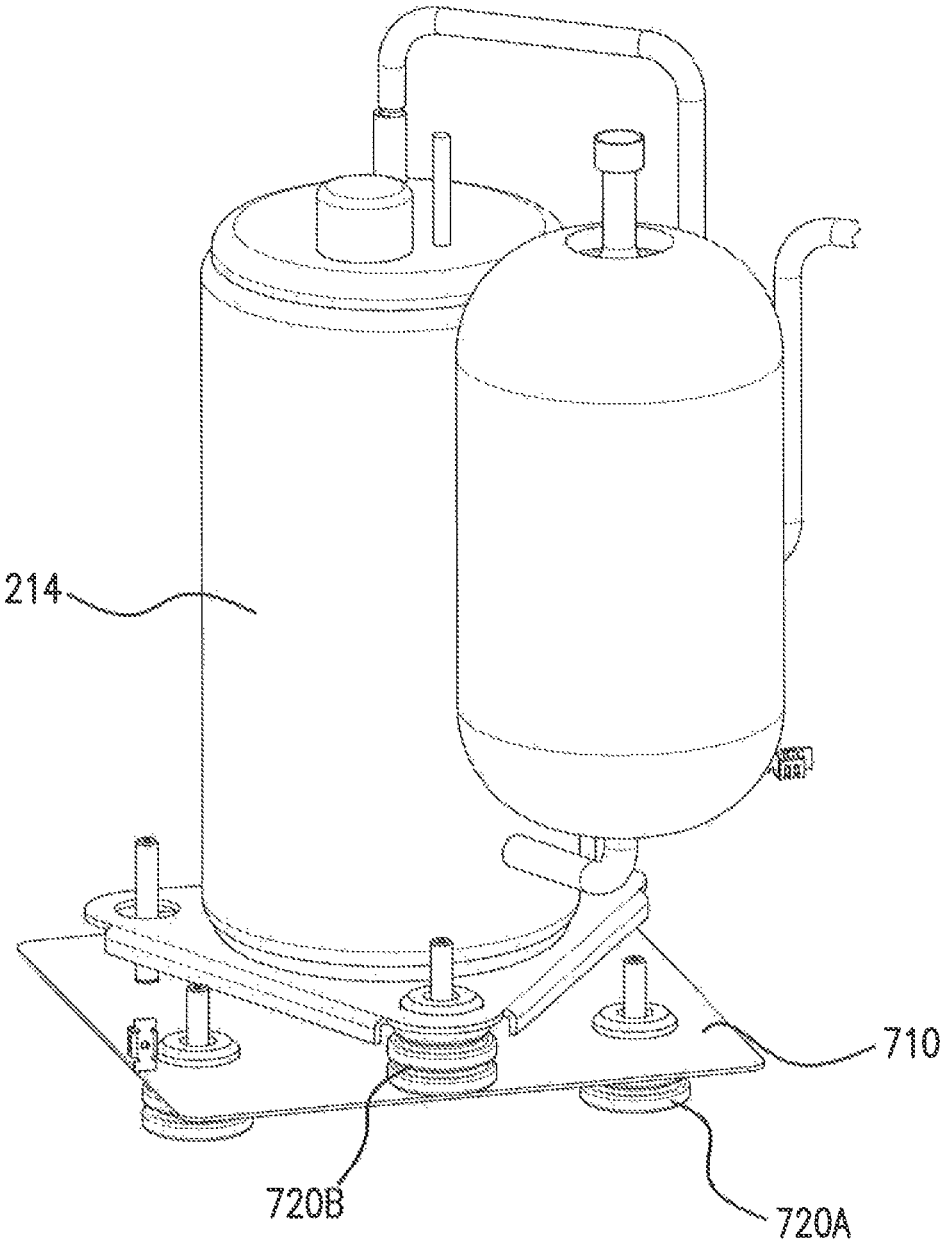
FIG. 7 illustrates a compressor that may be utilized by the dehumidification system of FIG. 2, according to certain embodiments.
Figure 8:
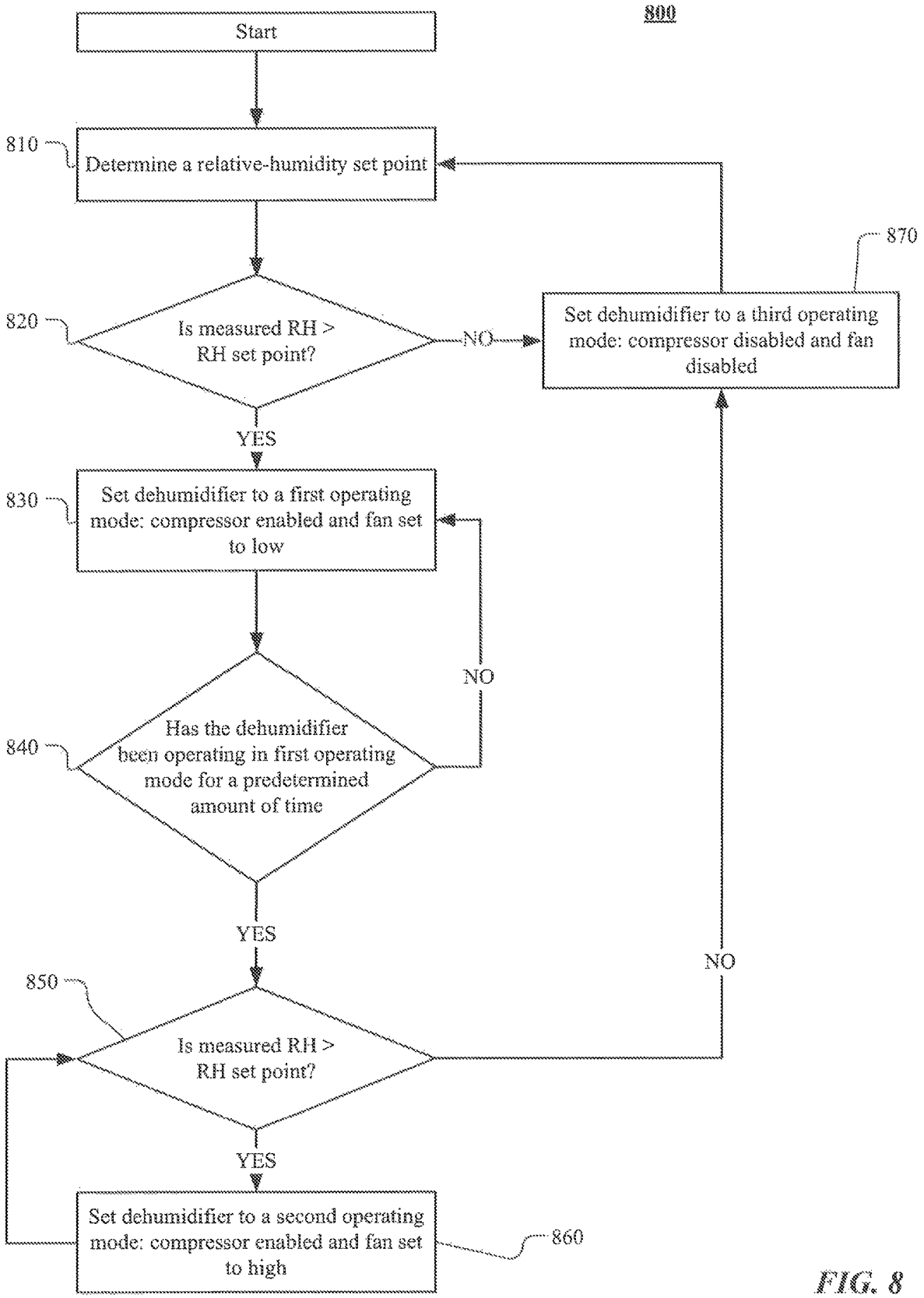
FIG. 8 illustrates a method of controlling the dehumidification system of FIG. 1, according to certain embodiments.
Figure 9:
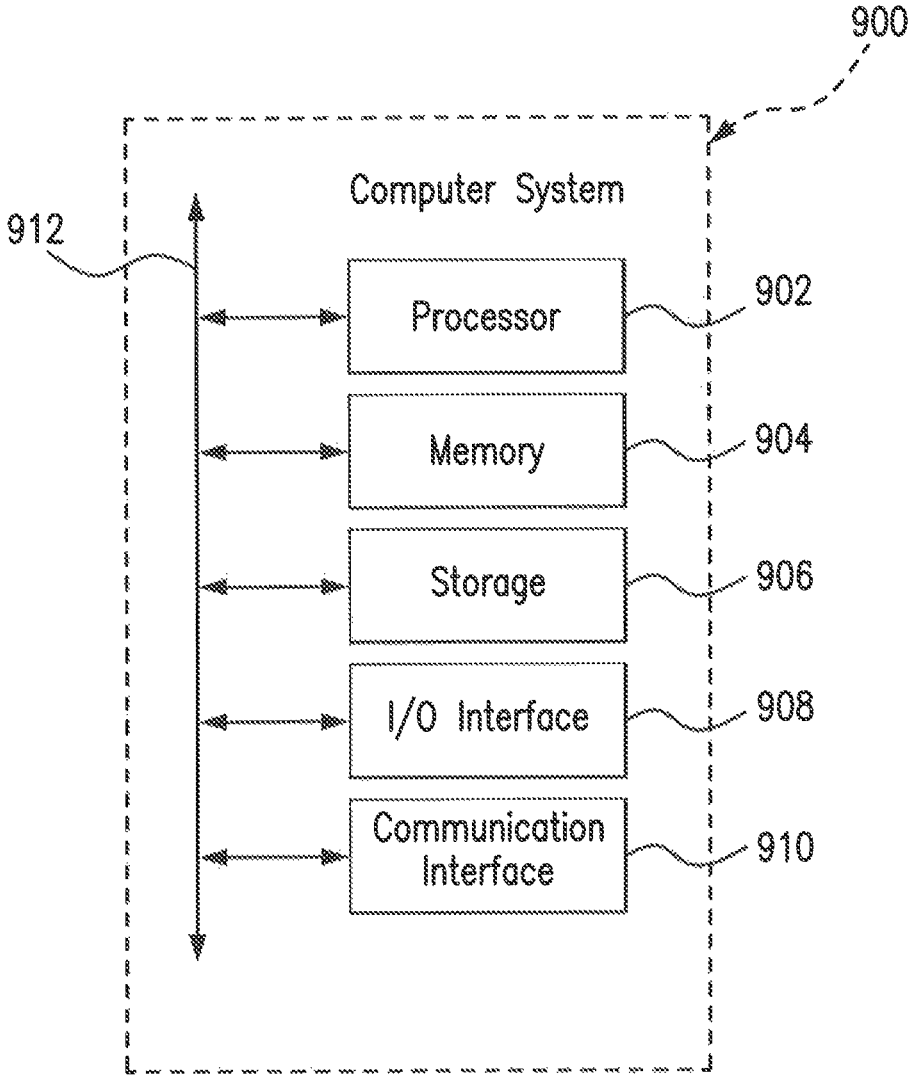
FIG. 9 illustrates an example computer system, according to certain embodiments.

These and other advantages and features of certain embodiments are discussed in more detail below in reference to FIGS. 1A-9. FIGS. 1A and 1B illustrate perspective views of certain embodiments of a dehumidification system; FIG. 2 illustrates certain embodiments of internal components of the dehumidification system of FIGS. 1A and 1B; FIG. 3 illustrates a perspective view of certain embodiments of a drain pan of the dehumidification system of FIG. 2; FIGS. 4A and 4B illustrate perspective views of certain embodiments of a top piece of the drain pan of FIG. 3; FIGS. 5A and 5B illustrate perspective views of certain embodiments of a bottom piece of the drain pan of FIG. 3; FIG. 6 illustrates support legs that may support the drain pan of FIG. 3; FIG. 7 illustrates a compressor that may be utilized by the dehumidification system of FIG. 2; FIG. 8 illustrates a method of controlling the dehumidification system of FIG. 1, and FIG. 9 illustrates an example computer system, according to certain embodiments.

Figure 1B:
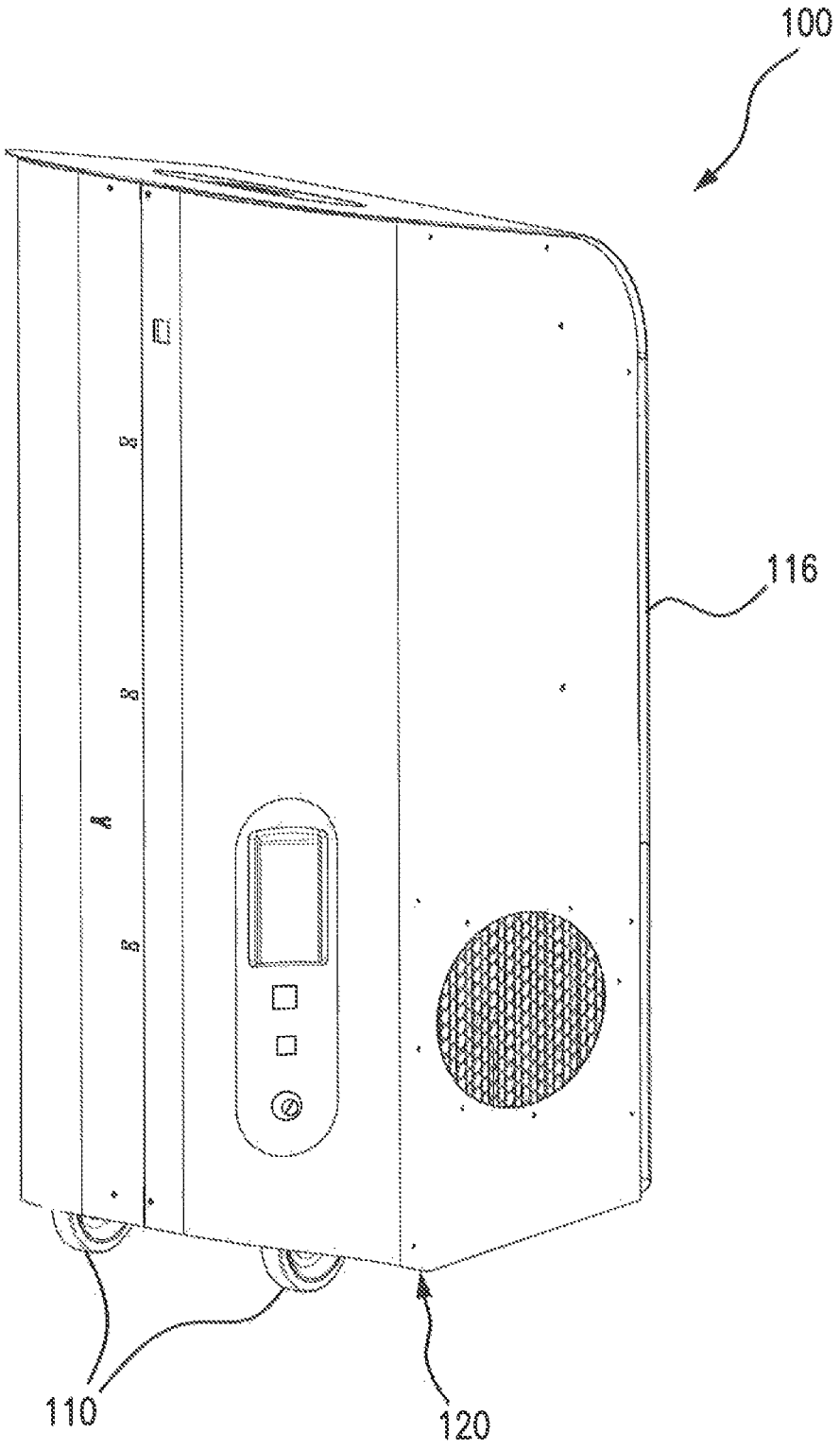

FIGS. 1A and 1B illustrate perspective views of a dehumidification system 100, according to certain embodiments. In some embodiments, dehumidification system 100 includes a cabinet 102, an airflow inlet 104, one or more airflow outlets 106, a control panel 108, and two or more wheels 110. While a specific arrangement of these and other components of portable dehumidifier 100 are illustrated, other embodiments may have other arrangements and may have more or fewer components than those illustrated.

In general, dehumidification system 100 provides dehumidification to an area (e.g., a room, a floor, etc.) by moving air through dehumidification system 100. To dehumidify air, dehumidification system 100 draws in a moist airflow 101 that enters cabinet 102 via airflow inlet 104, travels through the internal components of dehumidification system 100, and then exits cabinet 102 via one or more airflow outlets 106. Water removed from airflow 101 may be captured within a water reservoir (e.g., a drain pan) of dehumidification system 100. Certain embodiments of a drain pan that may be utilized by dehumidification system 100 are described in more detail below in reference to FIGS. 3-5B.

Cabinet 102 may be of any appropriate shape and size. In some embodiments, cabinet 102 includes multiple panels (or sides). For example, some embodiments of cabinet 102 include a top panel 112 and multiple side panels. In some embodiments as illustrated, airflow inlet 104 is on a front panel 114 of cabinet 102, airflow outlets 106 are on a left side panel 116 and a right side panel 118 of cabinet 102, respectively, and control panel 108 is on top panel 112 of cabinet 102. Wheels 110 are located on a bottom panel 120.

Airflow inlet 104 is generally any opening in which airflow 101 enters dehumidification system 100. In some embodiments, airflow inlet 104 is located on a front panel 114 as illustrated, but may be in any other appropriate location on other embodiments of dehumidification system 100. In some embodiments, airflow inlet 104 is square or rectangular in shape. In some embodiments, airflow inlet 104 is oval or circular in shape. In other embodiments, airflow inlet 104 may have any other appropriate shape or dimensions. In some embodiments, airflow inlet 104 includes a grate or grill that is formed out of geometric shapes. For example, some embodiments of airflow inlet 104 includes a grill formed from hexagons, octagons, and the like. In some embodiments, a removable air filter may be installed proximate to airflow inlet 104 to filter airflow 101 as it enters dehumidification system 100.

Airflow outlet 106 is generally any opening in which airflow 101 exits dehumidification system 100. In some embodiments, airflow outlet 106 is located on one or more side panels of cabinet 102 as illustrated, but may be in any other appropriate location on other embodiments of dehumidification system 100. Similar to airflow inlet 104, airflow outlet 106 may include a grate or grill that is formed out of geometric shapes such as hexagons, octagons, and the like. In some embodiments, airflow outlet 106 may be square or rectangular in shape, but may have any other appropriate shape or dimensions.

Control panel 108 provides various controls for an operator to control certain functions of portable dehumidifier 100. While control panel 108 is located on top panel 112 of cabinet 102 in some embodiments, control panel 108 may be located in any appropriate location on cabinet 102.

Embodiments of dehumidification system 100 may include two or more wheels 110. In some embodiments, portable dehumidification system 100 includes two wheels 110 on bottom panel 120 as illustrated that permit portable dehumidification system 100 to be tilted towards a back side of cabinet 102 and easily transported to a new location. Wheels 110 may be of any size and be made of any appropriate materials.

Dehumidification system 100 includes various internal components to provide dehumidification to airflow 101. As illustrated in FIG. 2, some embodiments of dehumidification system 100 include an evaporator 202, a condenser 204, an air plenum 206, a fan 208, a drain pan 210, an electrical box 212, a compressor 214, and multiple support legs 216. In some embodiments as illustrated, condenser 204 is sandwiched between evaporator 202 and air plenum 206. In some embodiments, evaporator 202 is located approximate to airflow inlet 104. In some embodiments, a removable air filter (not illustrated) may be provided between evaporator 202 and airflow inlet 104 to filter airflow 101 before it enters evaporator 202. In some embodiments, fan 208 is located adjacent to air plenum 206 as illustrated. In some embodiments, drain pan 210 is located at least partially below evaporator 202, condenser 204, and air plenum 206 as illustrated. In some embodiments, three or more support legs 216 are located below drain pan 210 to provide support for drain pan 210 as illustrated. In some embodiments, compressor 214 is located partially below drain pan 210 in an area surrounded by support legs 216 as illustrated. This may provide cooling for compressor 214 and further improve the efficiency of dehumidification system 100. In some embodiments, electrical box 212 is located partially below drain pan 210 and adjacent to compressor 214.

In general, the internal components of dehumidification system 100 are uniquely arranged to minimize the size of dehumidification system 100. For example, some embodiments of drain pan 210 may be a multi-piece drain pan that supports the weight of evaporator 202, condenser 204, and a filter installed proximate to evaporator 202. In such embodiments, drain pan 210 may be supported by one or more support legs 216 that extend from a bottom portion of 102 cabinet upwards towards drain pan 210. This allows for a more compact and upright configuration for the portable dehumidifier.

Evaporator 202 is configured to absorb heat from airflow 101 and condense the moisture in airflow 101. In some embodiments, evaporator 202 includes a finned-tube evaporator comprising tube coils covered with fins. The fins added to the tubes extend into the spaces between the tubes to permit more of airflow 101 to come into contact with cold evaporator 202. This design allows evaporator 202 to be made dimensionally smaller while still providing a reasonable heat transfer capability. During operation, evaporator 202 gets cold enough (close to the dewpoint) to pull water out of airflow 101. Water will drip down the coils of evaporator 202 to drain pan 210. In some embodiments, the tubes and the fins of evaporator 202 are made of copper or aluminum. In yet other embodiments, evaporator 202 may be any type of evaporators such as bare tube evaporator, plate evaporators, etc., and may be made of any appropriate material such as steel.

Condenser 204 is configured to heat and dry airflow 101. In some embodiments, condenser 204 includes a microchannel condenser comprising condenser coils that are made of aluminum. In general, a microchannel condenser provides numerous features including a high heat transfer coefficient, a low air-side pressure restriction, and a compact design (compared to other solutions such as finned tub exchangers). These and other features make microchannel condensers good options for condensers in air conditioning systems where inlet air temperatures are high and airflow is high with low fan power. In some embodiments, condenser 204 includes one condenser coil. In other embodiments, condenser 204 includes two or more condenser coils to achieve a reasonable temperature. In yet other embodiments, condenser 204 may be any type of condensers, and may be made of any appropriate material.

Evaporator 202 and condenser 204 make it possible to complete the heat exchange process. Cold evaporator 202 condenses the water in airflow 101, which is removed, and then airflow 101 is reheated by the condenser coils of condenser 204. The now dehumidified, re-warmed airflow 101 is vented out of cabinet 102 via the one or more airflow outlets 106.

Air plenum 206 is any appropriately-sized and shaped duct to guide the re-warmed airflow 101 to flow into a desired direction. In some embodiments, air plenum 206 includes a sheet metal box that provides a pathway for airflow 101. In yet other embodiments, air plenum 206 may be any type of plenum, and may be made of any appropriate material. In general, air plenum 206 is located between condenser 204 and fan 208 in some embodiments.

Dehumidification system 100 further includes a fan 208 that, when activated, draws airflow 101 into dehumidification system 100 via airflow inlet 104, causes airflow 101 to flow through components of dehumidification system 100 (e.g., evaporator 202 and condenser 204), and exhausts airflow 101 out of one or more airflow outlets 106. In some embodiments, fan 208 is located within cabinet 102 adjacent to air plenum 206 as illustrated in FIG. 2. In some embodiments, fan 208 is a backward inclined impeller configured to generate airflow 101 that flows through dehumidification system 100 for dehumidification and exits dehumidification system 100 through one or more airflow outlet 106. Fan 208 may be any other type of air mover (e.g., axial fan, forward inclined impeller, etc.) in other embodiments of dehumidification system 100. In some embodiments, fan 208 is a variable-speed direct current (DC) impeller.

Drain pan 210 is configured to collect water condensed from evaporator 202. Drain pan 210 is located at least partially below evaporator 202 and condenser 204 and provides physical support to these components. In some embodiments, drain pan 210 is any appropriate tank, basin, container, or area within cabinet 102 to collect and hold water removed from airflow 101. Particular embodiments of drain pan 210 are described in more detail below in reference to FIGS. 3-5.

Electrical box 212 is configured as an enclosure housing electrical connections for other electrical components of dehumidification system 100 to protect the connections as a safety barrier. In some embodiments, electrical box 212 is a metal box. In yet other embodiments, electrical box 212 may be made of any appropriate material such as plastic. In some embodiments, electrical box is located proximate to bottom panel 120 of cabinet 102 as illustrated.

Compressor 214 is configured to circulate the refrigerant in dehumidification system 100 under pressure. In some embodiments, compressor 212 is located partially below drain pan 210 as illustrated. In some embodiments, compressor 214 compresses refrigerant that travels through the coils in dehumidification system 100 to cool them down. For example, compressor 214 may pump the refrigerant to the coils of evaporator 202 to cool down the coils of evaporator 202. In some embodiments, compressor 212 is a rotary compressor that includes a shaft with multiple blades. The bladed shaft of the rotary compressor rotates inside the cylinder of the compressor and pushes the refrigerant through the cylinder of the compressor to compress it. Rotary compressors are small in size and quiet, which makes them a good candidate for compressors used in a portable dehumidifier. In some embodiments, compressor 212 may be any other type of compressor (e.g., reciprocating compressor, scroll compressor, screw compressor, centrifugal compressor, etc.).

Support legs 216 are configured to provide support for drain pan 210. In some embodiments, three or more support legs 216 are located below drain pan 210 and are attached to a bottom side of drain pan 210. In some embodiments, support legs 216 have multiple apertures 218 as illustrated. Apertures 218 permit airflow 101 to flow within dehumidification system 100 and not be blocked or significantly altered by support legs 216. In some embodiments, support legs 216 are made of metal. In yet other embodiments, support legs 216 may be made of any other appropriate material such as plastic. In some embodiments, apertures 218 are rectangular in shape. In yet other embodiments, apertures 218 may have any other appropriate shape and size. An enhanced view of support legs 216 is provided in FIG. 6.

In operation, moist airflow 101 is drawn into dehumidification system 100 via airflow inlet 104 by fan 208. Airflow 101 may travel through an air filter (not shown) before it reaches evaporator 202. The air filter may be used to remove solid particles such as dust, pollen, mold, and bacterial from airflow 101. The filtered airflow 101 then enters evaporator 202 where airflow 101 is cooled and water is condensed and removed from airflow 101. The water removed from airflow 101 drips down the coils of evaporator 202 and falls into drain pan 210. Next, the dry airflow 101 passes through condenser 204 and is reheated by the coils of condenser 204. The now dehumidified, re-warmed airflow 101 is drawn into air plenum 206 where it is directed downwards and exits dehumidification system 100 via one or more airflow outlets 106. In some embodiments, a hose (not shown) connected to drain pan 210 may be used to guide the water out of dehumidification system 100.

In some embodiments, dehumidification system 100 may be communicatively coupled to a remote server or computer system via a network such as the Internet in order to provide remote status and control functionality for dehumidification system 100. For example, dehumidification system 100 may connect wirelessly (e.g., Wifi, Bluetooth, etc.) or via a wired connection to the Internet or a computing device. In such embodiments, a computer system within dehumidification system 100 (e.g., computer system 900) may provide the functionality to connect to the network or the computing device. A user may then access settings and status of dehumidification system 100 using a client system that is connected to the network or directly to dehumidification system 100. For example, a user may utilize a smartphone running an app that communicates with dehumidification system 100 (either directly or via one or more intermediate servers) to display status of dehumidification system 100 (e.g., current relative humidity, etc.) and to control features of dehumidification system 100 (e.g., to turn dehumidification system 100 on or off). In some embodiments, a user may connect a client system such as a smartphone directly to dehumidification system 100 in the absence of a network (e.g., a direct connection to dehumidification system 100 via Bluetooth).

In some embodiments, a remote sensing unit may be utilized by dehumidification system 100 to remotely sense environmental conditions. For example, a remote sensing unit may connect to dehumidification system 100 either via a wired connection (e.g., RJ12) or a wireless connection (e.g., Bluetooth). The remote sensing unit may include an onboard relative humidity (RH) sensor that may be used by dehumidification system 100 to sense the humidity levels at a location that is away from dehumidification system 100. For example, the remote sensing unit may be placed in one area of a house while dehumidification system 100 is placed in another. This may allow dehumidification system 100 to more accurately detect the overall humidity levels of a living space (as opposed to an internally-mounted RH sensor). In some embodiments, dehumidification system 100 may automatically detect that a connection to a remote sensing unit has been established and use the readings from the sensor within the remote sensing unit instead of an internally-mounted sensor.

FIG. 3 illustrates a perspective view of drain pan 210 of dehumidification system 100, according to certain embodiments. Drain pan 210 is generally used to collect water condensed from evaporator 202. In some embodiments, drain pan 210 is any appropriate tank, basin, container, or area within cabinet 102 to collect and hold water removed from airflow 101. In some embodiments, drain pan 210 is located at least partially below evaporator 202, condenser 204, and air plenum 206. In some embodiments, drain pan 210 includes a top piece 310, a bottom piece 320, a float switch 330, and a mesh strainer 340 as illustrated. In some embodiments, top piece 310 is configured to support evaporator 202, collect condensed water from evaporator 202, and funnel the condensed water into bottom piece 320. In some embodiments, bottom piece 320 is configured to hold the condensed water funneled from top piece 310. Bottom piece 320 further provides support for condenser 204 and an air filter (not shown). In some embodiments, a mesh strainer 340 is coupled to top piece 310 to filter the condensed water to prevent debris from reaching bottom piece 320 as illustrated. Mesh strainer 340 filters the condensed water to prevent debris from reaching bottom piece 320 and damaging other components (e.g., a pump) of dehumidification system 100. In some embodiments, a float switch 330 is coupled to top piece 310 as illustrated. Float switch 330 is used to toggle/activate a pump (not shown) that is used to drain the condensed water out of drain pan 210. During operation, once the condensed water accumulated in bottom piece 320 reaches the level of float switch 330, the pump activates and drains the condensed water out of bottom piece 320.

Referring to FIGS. 4A and 4B, top piece 310 of drain pan 210 may include multiple bottom panels 402, multiple raised ribs 404, a hook 406, a strainer holder 408, and a drainage opening 410. In some embodiments, top piece 310 is made of plastic and is manufactured using an injection molding process. In yet other embodiments, top piece 310 may be made of any other appropriate material.

In general, top piece 310 of drain pan 210 is configured to physically support evaporator 202. During assembly of dehumidification system 100, top piece 310 of drain pan 210 is coupled, affixed, or otherwise placed on top of bottom piece 320 of drain pan 210. Multiple features (e.g., apertures, protrusions, etc.) may be included on top piece 310 and bottom piece 320 to properly align and couple the two pieces together. Once top piece 310 of drain pan 210 is coupled, affixed, or placed on top of bottom piece 320, evaporator 202 may then be placed on top of top piece 310. In some embodiments, one or more ribs 404 of top piece 310 may be taller than other ribs 404 as illustrated to guide the placement of evaporator 202 onto top piece 310.

In some embodiments, bottom panels 402 are sloped to allow condensed water to flow towards drainage opening 410. In some embodiments, multiple rows of raised ribs 404 are placed on bottom panels 402 as illustrated. In some embodiments, raised ribs 404 are positioned to be underneath the lowest tube of evaporator 202 and are configured to restrict an area between evaporator 202 and top piece 310 through which air may pass. Raised ribs 404 minimize a gap between evaporator 202 and top piece 310, which prevents airflow 101 from going underneath evaporator 202 and picking up the condensed water. In this way, raised ribs 404 prevent condensed water from being entrained in airflow 101.

Hook 406 is configured to hold float switch 330. In some embodiments, hook 406 is located on a side of top piece 310. Hook 406 may be made of any appropriate material and has any appropriate shape to hold float switch 330. Strainer holder 408 is configured to hold mesh strainer 340. In some embodiments, strainer holder 408 is located on a same side of top piece 310 as hook 406 and proximate to drainage opening 410. In some embodiments, strainer holder 408 has a horseshoe shape as illustrated. In yet other embodiments, strainer holder 408 may have any other appropriate shape. Drainage opening 410 is located on a same side of top piece 310 as hook 406 and strainer holder 408, in some embodiments as illustrated. Drainage opening 410 may be any appropriate size and have any appropriate shape to allow condensed water to flow out of top piece 310 and down to bottom piece 320.

Referring to FIGS. 5A and 5B, bottom piece 320 of drain pan 210 may include a front ledge 502, a central chamber 504, and a back shelf 506. Central chamber 504 is sandwiched between front ledge 502 and back shelf 506. In some embodiments, bottom piece 320 is made of plastic and is manufactured using an injection molding process. In yet other embodiments, bottom piece 320 may be made of any other appropriate material.

In general, bottom piece 320 of drain pan 210 is configured to physically support condenser 204 and in some embodiments, air plenum 206 and an air filter. During assembly of dehumidification system 100, top piece 310 of drain pan 210 is coupled, affixed, or otherwise placed on top of bottom piece 320 of drain pan 210. Once top piece 310 of drain pan 210 is coupled, affixed, or placed on top of bottom piece 320, condenser 204 may then be placed on back shelf 206 of bottom piece 320. In addition, an air filter may be placed on front ledge 502 and air plenum 206 may be placed on back shelf 506. As a result, bottom piece 320 physically supports condenser 204 and in some embodiments, air plenum 206 and an air filter.

Front ledge 502 is configured to support a filter (not shown) placed proximate to evaporator 202. In some embodiments, front ledge 502 is mechanically coupled to support legs 216 at the bottom of front ledge 502. In some embodiments, front ledge 502 is attached to central chamber 502 as illustrated.

Central chamber 504 is configured to hold condensed water drained from top piece 310. Central chamber includes a base panel 508, an enclosed wall 510, and a basin 512, in some embodiments as illustrated. Base panel 508 may be positioned horizontally in an area under strainer holder 408 of top piece 310. In some embodiments, enclosed wall 510 is located on base panel 510 in an area directly underneath mesh strainer 340 held by strainer holder 408. In some embodiments, enclosed wall 510 has a rectangular shape as illustrated. In yet other embodiments, enclosed wall 510 may have any other appropriate shape (e.g., circular). Enclosed wall 510 is configured to catch any soft particles or sediment that escape mesh strainer 340. During operation, condensed water in top piece 310 flows out of top piece 310 via drainage opening 410, passes through mesh strainer 340, and is directed to an area within enclosed wall 510 of base panel 508. After enough condensed water accumulates within enclosed wall 510, the condensed water flows over enclosed wall 510 to base panel 508 and into basin 512. Enclosed wall 510 provides a second protection mechanism for catching debris or particles in the condensed water and prevents the debris and particles from damaging other components of the dehumidification system in addition to mesh strainer 340. In some embodiments, basin 512 is located adjacent to base panel 508. In some embodiments, basin 512 is any appropriate tank, container, or area within central chamber 504 to collect and hold water. In some embodiments, basin 512 has a sloped bottom as illustrated. Basin 512 may further include a hose connection 514 at a lower portion of basin 512. A hose may be connected to hose connection 514 in order to drain condensed water out of basin 512.

Back shelf 506 is configured to physically support condenser 204 and air plenum 206. In some embodiments, back shelf 506 is a flat piece attached to central chamber 504. In some embodiments, back shelf 506 is disposed partially above electrical box 212.

FIG. 6 illustrates enhanced views of support legs 216 that may support drain pan 210, according to certain embodiments. In general, support legs 216 connect drain pan 210 to the lower portion of cabinet 102, thereby providing an area for compressor 214 and other components of dehumidification system 100. In some embodiments, dehumidification system 100 includes three support legs 216 as illustrated. In such embodiments, two support legs 216 may be coupled to a bottom surface of front ledge 502 of drain pan 210, and one support leg may be coupled to a bottom surface of back shelf 206 of drain pan 210 as illustrated. In other embodiments, any number of support legs 216 may be utilized. Furthermore, support legs 216 may be coupled to any appropriate location on drain pan 210.

In some embodiments, support legs 216 include one or more apertures 218. Apertures 218 may be in any appropriate shape, have any appropriate dimensions, and be in any location on support legs 216. For example, apertures 218 may be square, rectangular, or circular in shape. In general, apertures 218 permit airflow 101 to flow throughout dehumidification system 100 without being impeded by support legs 216. In other words, apertures 218 permit airflow 101 to flow through support legs 216 but still permit support legs 216 to support the weight of drain pan 210 and the components resting on drain pan 210.

FIG. 7 illustrates a compressor 214 that may be utilized by dehumidification system 100, according to certain embodiments. In some embodiments, compressor 214 may be located below drain pan 210 in an area created by support legs 216. In some embodiments, compressor 214 may be affixed or coupled to cabinet 102 using a metal plate 710. To reduce noise, some embodiments may utilize two layers of grommets 720 to couple compressor 214 to cabinet 102 and to isolate the vibration of compressor 214 from cabinet 102. For example, a first layer of grommets 720A may be included between metal plate 710 and cabinet 102, and a second layer of grommets 720B may be included between compressor 214 and metal plate 710. Any number or type of grommets 720 may be used.

FIG. 8 illustrates a method 800 of controlling dehumidification system 100, according to certain embodiments. In general, method 800 may be utilized by dehumidification system 100 to reduce the amount of noise generated by dehumidification system 100 and to reduce the amount of energy consumed by dehumidification system 100. Method 800 may begin in step 810 where an RH set point is determined. In some embodiments, a user may set the RH set point using control panel 108. In some embodiments, the RH set point is accessed or otherwise retrieved from memory (e.g., within dehumidification system 100). An example RH set point may be anywhere between 35 and 50%.

At step 820, method 800 compares a measured RH to the RH set point of step 810. In some embodiments, the measured RH level of incoming airflow 101 may be retrieved from any appropriate sensor (e.g., a humidistat) that is located within airflow 101 as it enters dehumidification system 100. If the measured RH is greater than the RH set point (or, in some embodiments, is equal to the RH set point), method 800 may proceed to step 830. If the measured RH is less than the RH set point (or, in some embodiments, is equal to the RH set point), method 800 may proceed to step 870.

At step 830, method 800 sets dehumidification system 100 to a first operating mode. In some embodiments, compressor 214 of dehumidification system 100 is enabled and fan 208 of dehumidification system 100 is set to a first speed in the first operating mode. In some embodiments, the first speed of step 830 is a low or minimum fan speed.

At step 840, method 800 determines whether dehumidification system 100 has been operating in the first operating mode for a predetermined amount of time. If method 800 determines in step 840 that dehumidification system 100 has been operating in the first operating mode for at least the predetermined amount of time, method 800 may proceed to step 850. Otherwise, if method 800 determines in step 840 that dehumidification system 100 has not been operating in the first operating mode for at least the predetermined amount of time, method 800 may proceed back to step 830 or step 840. For example, if dehumidification system 100 has been operating in the first operating mode for thirty minutes, method 800 may proceed to step 850. In some embodiments, the predetermined amount of time is a setting that may be set by a user using control panel 108.

At step 850, method 800 compares a measured RH to the RH set point of step 810. If the measured RH is greater than the RH set point (or, in some embodiments, is equal to the RH set point), method 800 may proceed to step 860. If the measured RH is less than the RH set point (or, in some embodiments, is equal to the RH set point), method 800 may proceed to step 870.

At step 860, method 800 sets dehumidification system 100 to a second operating mode. In some embodiments, compressor 214 of dehumidification system 100 is enabled and fan 208 of dehumidification system 100 is set to a second speed in the second operating mode. In some embodiments, the second speed of step 860 is greater than the first speed of step 830. In some embodiments, the second speed of step 860 is a high or maximum speed. After step 860, method 800 may end or proceed back to step 850.

At step 870, method 800 sets dehumidification system 100 to a third operating mode. In some embodiments, compressor 214 of dehumidification system 100 is disabled and fan 208 of dehumidification system 100 is disabled in the third operating mode. After step 870, method 800 may end or proceed back to step 810.

Particular embodiments may repeat one or more steps of method 800, where appropriate. Although this disclosure describes and illustrates particular steps of method 800 as occurring in a particular order, this disclosure contemplates any suitable steps of method 800 occurring in any suitable order. Moreover, although this disclosure describes and illustrates an example method for controlling dehumidification system 100 including the particular steps of method 800, this disclosure contemplates any suitable method for controlling dehumidification system 100 including any suitable steps, which may include all, some, or none of the steps of method 800, where appropriate. Furthermore, although this disclosure describes and illustrates particular components, devices, or systems carrying out particular steps of method 800, this disclosure contemplates any suitable combination of any suitable components, devices, or systems carrying out any suitable steps of method 800.

FIG. 9 illustrates an example computer system 900. In particular embodiments, one or more computer systems 900 perform one or more steps of one or more methods described or illustrated herein. In particular embodiments, one or more computer systems 900 provide functionality described or illustrated herein. In particular embodiments, software running on one or more computer systems 900 performs one or more steps of one or more methods described or illustrated herein or provides functionality described or illustrated herein. Particular embodiments include one or more portions of one or more computer systems 900. Herein, reference to a computer system may encompass a computing device, and vice versa, where appropriate. Moreover, reference to a computer system may encompass one or more computer systems, where appropriate.

This disclosure contemplates any suitable number of computer systems 900. This disclosure contemplates computer system 900 taking any suitable physical form. As example and not by way of limitation, computer system 900 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 900 may include one or more computer systems 900; be unitary or distributed; span multiple locations; span multiple machines; span multiple data centers; or reside in a cloud, which may include one or more cloud components in one or more networks. Where appropriate, one or more computer systems 900 may perform without substantial spatial or temporal limitation one or more steps of one or more methods described or illustrated herein. As an example and not by way of limitation, one or more computer systems 900 may perform in real time or in batch mode one or more steps of one or more methods described or illustrated herein. One or more computer systems 900 may perform at different times or at different locations one or more steps of one or more methods described or illustrated herein, where appropriate.

In particular embodiments, computer system 900 includes a processor 902, memory 904, storage 906, an input/output (I/O) interface 908, a communication interface 910, and a bus 912. Although this disclosure describes and illustrates a particular computer system having a particular number of particular components in a particular arrangement, this disclosure contemplates any suitable computer system having any suitable number of any suitable components in any suitable arrangement.

In particular embodiments, processor 902 includes hardware for executing instructions, such as those making up a computer program. Processor 902 may be any appropriate processing unit, microprocessor, computer, computing system, and the like. As an example and not by way of limitation, to execute instructions, processor 902 may retrieve (or fetch) the instructions from an internal register, an internal cache, memory 904, or storage 906; decode and execute them; and then write one or more results to an internal register, an internal cache, memory 904, or storage 906. In particular embodiments, processor 902 may include one or more internal caches for data, instructions, or addresses. This disclosure contemplates processor 902 including any suitable number of any suitable internal caches, where appropriate. As an example and not by way of limitation, processor 902 may include one or more instruction caches, one or more data caches, and one or more translation lookaside buffers (TLBs). Instructions in the instruction caches may be copies of instructions in memory 904 or storage 906, and the instruction caches may speed up retrieval of those instructions by processor 902. Data in the data caches may be copies of data in memory 904 or storage 906 for instructions executing at processor 902 to operate on; the results of previous instructions executed at processor 902 for access by subsequent instructions executing at processor 902 or for writing to memory 904 or storage 906; or other suitable data. The data caches may speed up read or write operations by processor 902. The TLBs may speed up virtual-address translation for processor 902. In particular embodiments, processor 902 may include one or more internal registers for data, instructions, or addresses. This disclosure contemplates processor 902 including any suitable number of any suitable internal registers, where appropriate. Where appropriate, processor 902 may include one or more arithmetic logic units (ALUs); be a multi-core processor; or include one or more processors 902. Although this disclosure describes and illustrates a particular processor, this disclosure contemplates any suitable processor.

In particular embodiments, memory 904 includes main memory for storing instructions for processor 902 to execute or data for processor 902 to operate on. As an example and not by way of limitation, computer system 900 may load instructions from storage 906 or another source (such as, for example, another computer system 900) to memory 904. Processor 902 may then load the instructions from memory 904 to an internal register or internal cache. To execute the instructions, processor 902 may retrieve the instructions from the internal register or internal cache and decode them. During or after execution of the instructions, processor 902 may write one or more results (which may be intermediate or final results) to the internal register or internal cache. Processor 902 may then write one or more of those results to memory 904. In particular embodiments, processor 902 executes only instructions in one or more internal registers or internal caches or in memory 904 (as opposed to storage 906 or elsewhere) and operates only on data in one or more internal registers or internal caches or in memory 904 (as opposed to storage 906 or elsewhere). One or more memory buses (which may each include an address bus and a data bus) may couple processor 902 to memory 904. Bus 912 may include one or more memory buses, as described below. In particular embodiments, one or more memory management units (MMUs) reside between processor 902 and memory 904 and facilitate accesses to memory 904 requested by processor 902. In particular embodiments, memory 904 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 904 may include one or more memories 904, where appropriate. Although this disclosure describes and illustrates particular memory, this disclosure contemplates any suitable memory.

In particular embodiments, storage 906 includes mass storage for data or instructions. As an example and not by way of limitation, storage 906 may include a hard disk drive (HDD), a floppy disk drive, flash memory, an optical disc, a magneto-optical disc, magnetic tape, or a Universal Serial Bus (USB) drive or a combination of two or more of these. Storage 906 may include removable or non-removable (or fixed) media, where appropriate. Storage 906 may be internal or external to computer system 900, where appropriate. In particular embodiments, storage 906 is non-volatile, solid-state memory. In particular embodiments, storage 906 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 906 taking any suitable physical form. Storage 906 may include one or more storage control units facilitating communication between processor 902 and storage 906, where appropriate. Where appropriate, storage 906 may include one or more storages 906. Although this disclosure describes and illustrates particular storage, this disclosure contemplates any suitable storage.

In particular embodiments, I/O interface 908 includes hardware, software, or both, providing one or more interfaces for communication between computer system 900 and one or more I/O devices. Computer system 900 may include one or more of these I/O devices, where appropriate. One or more of these I/O devices may enable communication between a person and computer system 900. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 908 for them. Where appropriate, I/O interface 908 may include one or more device or software drivers enabling processor 902 to drive one or more of these I/O devices. I/O interface 908 may include one or more I/O interfaces 908, where appropriate. Although this disclosure describes and illustrates a particular I/O interface, this disclosure contemplates any suitable I/O interface.

In particular embodiments, communication interface 910 includes hardware, software, or both providing one or more interfaces for communication (such as, for example, packet-based communication) between computer system 900 and one or more other computer systems 900 or one or more networks. As an example and not by way of limitation, communication interface 910 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 910 for it. As an example and not by way of limitation, computer system 900 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 900 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 900 may include any suitable communication interface 910 for any of these networks, where appropriate. Communication interface 910 may include one or more communication interfaces 910, where appropriate. Although this disclosure describes and illustrates a particular communication interface, this disclosure contemplates any suitable communication interface.

In particular embodiments, bus 912 includes hardware, software, or both coupling components of computer system 900 to each other. As an example and not by way of limitation, bus 912 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 912 may include one or more buses 912, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A portable dehumidifier, comprising:

a cabinet comprising:

an airflow inlet located on a front side of the cabinet;

an airflow outlet located on a side of the cabinet; and at least two wheels coupled to a bottom side of the cabinet;

an evaporator located adjacent to the airflow inlet;

a condenser located adjacent to the evaporator and on a side of the evaporator opposite the airflow inlet;

a drain pan located at least partially below the evaporator and the condenser, the drain pain configured to support weight of the evaporator and the condenser;

a plurality of support legs extending from a bottom side of the drain pan towards the bottom side of the cabinet;

a compressor located below the drain pan;

a fan located adjacent to the condenser and on a side of the condenser opposite the evaporator, the fan configured to generate an airflow that flows into the cabinet through the airflow inlet and out of the cabinet through the airflow outlet, the airflow flowing through the evaporator and the condenser in order to provide dehumidification to the airflow; and a processor configured to:

determine a relative humidity set point;

in response to determining that a measured relative humidity is greater than or equal to the relative humidity set point, set the portable dehumidifier to a first operating mode, wherein the compressor is enabled and the fan is set to a first fan speed while in the first operating mode;

determine whether the portable dehumidifier has been operating in the first operating mode for a predetermined amount of time, and in response, set the portable dehumidifier to a second operating mode if the measured relative humidity is still greater than the relative humidity set point in order to reduce the measured relative humidity, wherein the compressor is enabled and the fan is set to a second fan speed while in the second operating mode, the second fan speed being greater than the first fan speed; and in response to determining that the measured relative humidity is less than the relative humidity set point, set the portable dehumidifier to a third operating mode, wherein the compressor is disabled and the fan is disabled while in the third operating mode.

2. The portable dehumidifier of claim 1, wherein the fan is a variable-speed direct current (DC) impeller.

3. The portable dehumidifier of claim 1, wherein the measured relative humidity is obtained from a sensor that is mounted within the portable dehumidifier.

4. The portable dehumidifier of claim 1, wherein the measured relative humidity is obtained from a sensor remote from the portable dehumidifier.

5. The portable dehumidifier of claim 1, wherein the relative humidity set point is a user-controllable setting.

6. A dehumidifier, comprising:

an evaporator;

a condenser;

a fan configured to generate an airflow that flows through the evaporator and the condenser in order to provide dehumidification to the airflow; and a processor configured to:

determine a relative humidity set point;

in response to determining that a measured relative humidity is greater than or equal to the relative humidity set point, set the dehumidifier to a first operating mode, wherein a compressor of the dehumidifier is enabled and the fan is set to a first fan speed while in the first operating mode;

determine whether the dehumidifier has been operating in the first operating mode for a predetermined amount of time, and in response, set the dehumidifier to a second operating mode if the measured relative humidity is still greater than the relative humidity set point, in order to reduce the measured relative humidity the compressor is enabled, wherein the compressor is enabled and the fan is set to a second fan speed while in the second operating mode, the second fan speed being greater than the first fan speed; and in response to determining that the measured relative humidity is less than the relative humidity set point, set the dehumidifier to a third operating mode, wherein the compressor is disabled and the fan is disabled while in the third operating mode.

7. The dehumidifier of claim 6, wherein the fan is a variable-speed direct current (DC) impeller.

8. The dehumidifier of claim 6, wherein the measured relative humidity is obtained from a sensor that is mounted within the dehumidifier.

9. The dehumidifier of claim 6, wherein the measured relative humidity is obtained from a sensor remote from the dehumidifier.

10. The dehumidifier of claim 6, wherein the relative humidity set point is a user-controllable setting.

11. A method, comprising:

determining, by a dehumidifier, a relative humidity set point;

in response to determining that a measured relative humidity is greater than or equal to the relative humidity set point, setting the dehumidifier to a first operating mode, wherein a compressor of the dehumidifier is enabled and a fan of the dehumidifier is set to a first fan speed while in the first operating mode;

determining, by the dehumidifier, whether the dehumidifier has been operating in the first operating mode for a predetermined amount of time, and in response, setting the dehumidifier to a second operating mode if the measured relative humidity is still greater than the relative humidity set point, in order to reduce the measured relative humidity the compressor is enabled, wherein the compressor is enabled and the fan is set to a second fan speed while in the second operating mode, the second fan speed being greater than the first fan speed; and in response to determining that the measured relative humidity is less than the relative humidity set point, setting the dehumidifier to a third operating mode, wherein the compressor is disabled and the fan is disabled while in the third operating mode.

12. The method of claim 11, wherein the fan is a variable-speed direct current (DC) impeller.

13. The method of claim 11, wherein the measured relative humidity is obtained from a sensor that is mounted within the dehumidifier.

14. The method of claim 11, wherein the measured relative humidity is obtained from a sensor remote from the dehumidifier.

* * * * *